United States Patent [19]

Den Besten

[11] Patent Number: 4,775,189

[45] Date of Patent: Oct. 4, 1988

[54] BUSHING PLATE CUTTER

[76] Inventor: Leroy E. Den Besten, Westlyn Grove Box 344, Valatie, N.Y. 12184

[21] Appl. No.: 69,052

[22] Filed: Jul. 2, 1987

[51] Int. Cl.[4] ..... E02F 3/08; E02F 5/06

[52] U.S. Cl. ..... 299/82; 37/83; 37/191 A; 299/83

[58] Field of Search ..... 299/82–84, 299/91, 25, 36; 37/191 A, 80, 83, 192 A

[56] References Cited

U.S. PATENT DOCUMENTS

| | | | |
|---|---|---|---|
| 3,913,979 | 10/1975 | Strauss et al. | 299/84 |
| 3,954,301 | 5/1976 | Stepp | 299/84 X |
| 4,404,761 | 9/1983 | Paulin et al. | 299/82 X |
| 4,626,032 | 12/1986 | Harris et al. | 299/84 X |

*Primary Examiner*—George A. Suchfield
*Assistant Examiner*—David J. Bagnell
*Attorney, Agent, or Firm*—Kane, Dalsimer, Sullivan, Kurucz, Levy, Eisele and Richard

[57] ABSTRACT

A bushing plate cutter for excavating trenches in various surfaces such as asphalt, concrete, rocky, or icy ground has a plurality of abutting top plates with bushings welded to one end of the top plates and blocks having holes therein for carrying cutting bits welded to the other side of the top plates. Sets of side plates each contain two parallel side plates abutting and perpendicular to the top plates. The side plates are connected to each other by oppositely oriented bolts which pass through the bushings and the links of a chain element. The configuration is such that there is uniform distance between the cutting bits.

3 Claims, 4 Drawing Sheets

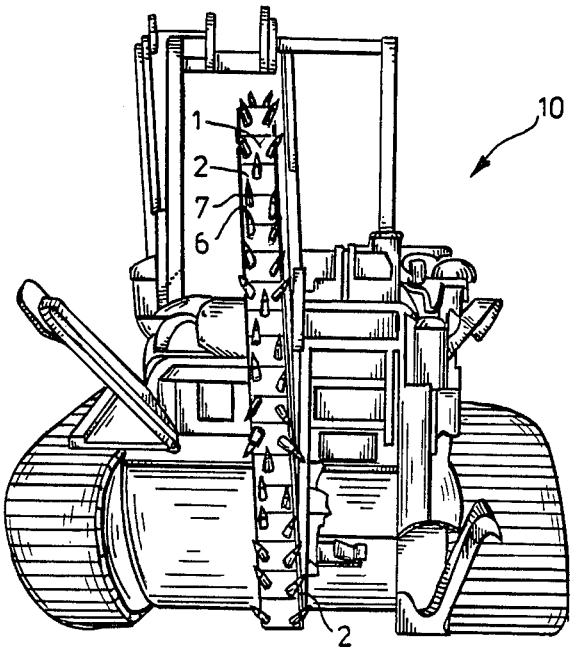
FIG.4
FIG.5
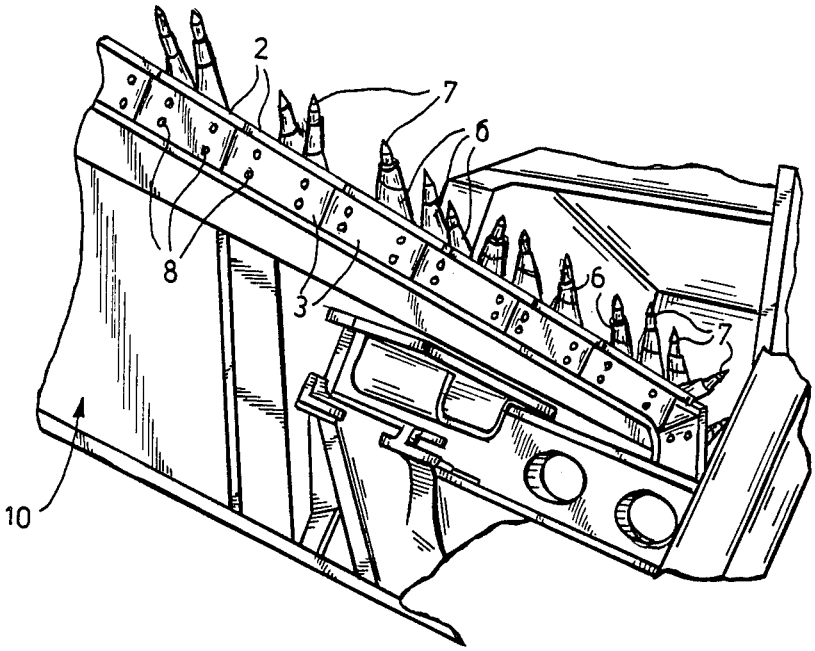

BUSHING PLATE CUTTER

BACKGROUND OF THE INVENTION

1. Field of the Invention

This invention relates to a bushing plate cutter for excavating trenches and various road surfaces.

2. Description of the Prior Art

Various types of apparatus have been developed for cutting trenches in such diverse surfaces as city street asphalt, concrete, rocky, or frozen grounds. A typical prior art apparatus comprises a chain having a plurality of linked elements, a plurality of sets of parallel "L" shaped bushings, a plate member having two horizontal members and a centrally located vertical member with holes in the horizontal members for bolting the horizontal members to the short leg of the "L" shaped bushing through holes in the short leg of the "L" shaped bushing with the long legs of the "L" shaped bushings bolted to each other and to the chain element. This prior art apparatus had a block mounted on the vertical element of the top plate wherein drill bits could be mounted. Because the top plates of the aforementioned apparatus were not adjacent to each other, such problems as backlash and/or back buckling existed.

OBJECTIVES AND SUMMARY OF THE INVENTION

It is an object of the present invention to provrde a bushing plate cutter for excavating trenches in various surfaces wherein the bushing plate cutter is resistant to backlash and/or back buckling.

It is a further object of the present invention to provide a bushing plate cutter wherein adjacent bolts in each subassembly of the cutter are inserted in opposed direction to insure tightness of attachment among the elements.

It is yet another object of the present invention to construct a bushing plate cutter which closely resembles a wheel in shape such that a smoother running cutter assembly can be achieved.

These and other objects and advantages of the invention will be made clear from the following description of the invention.

The bushing plate cutter of the present invention comprises a set of top plates abutting each other, and having bushings welded to one side, and blocks welded to the other side. The blocks have means for mounting drill bits therein. The bushing plate cutter also comprises a chain comprising a plurality of linked elements and a plurality of sets of side plates, each set of side plates comprising two parallel side plates abutting and perpendicular to the top plate and connected through the chain and the bushings and to each other by means of opposed nuts and bolts.

BRIEF DESCRIPTION OF THE DRAWINGS

FIG. 4 shows a perspective view of a trenching apparatus using the bushing plate cutter of the present in invention.

FIG. 5 shows a perspective view of some of the trenching apparatus shown in FIG. 4.

DETAILED DESCRIPTION OF THE INVENTION

Figure 1:
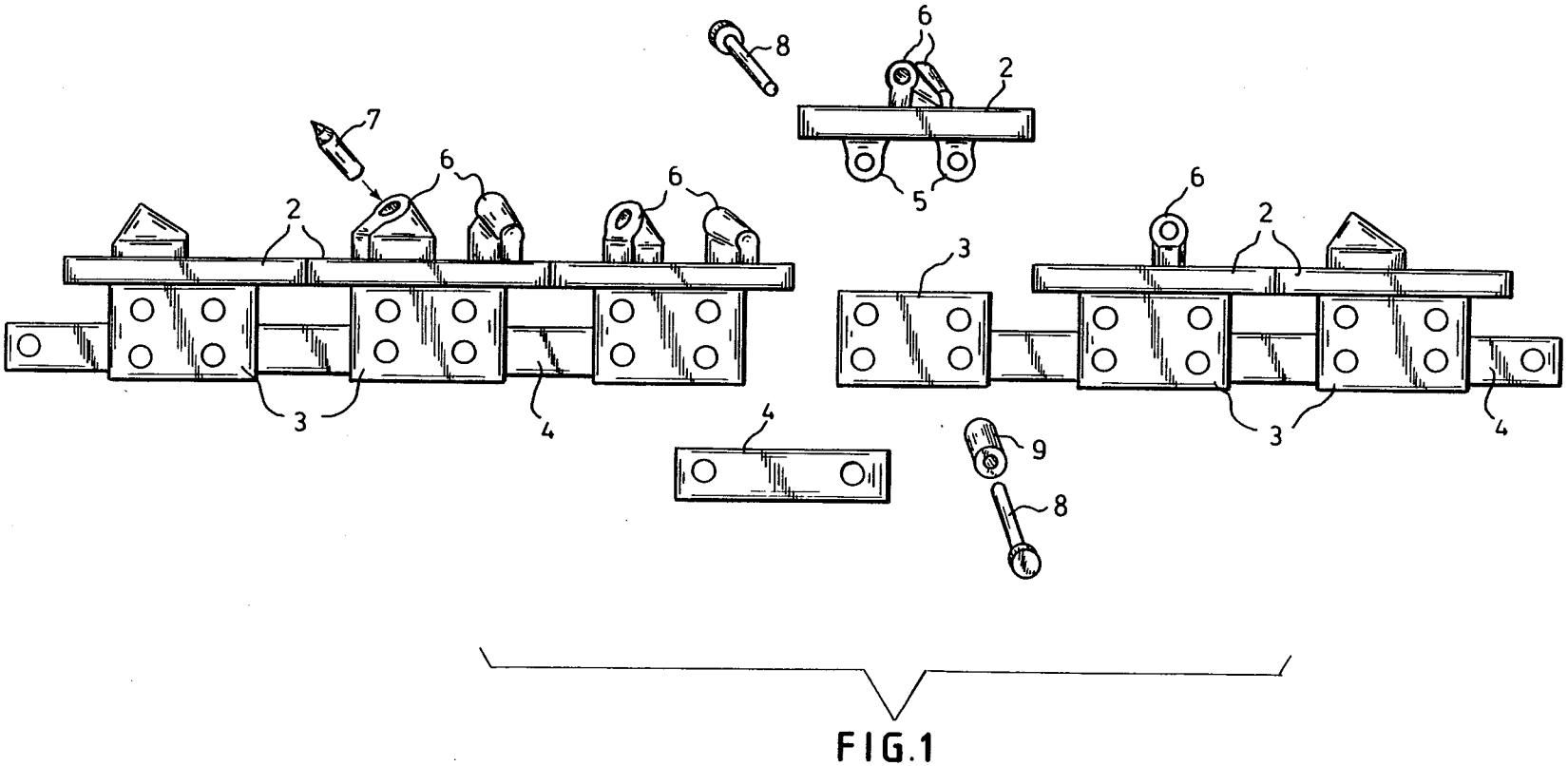
FIG. 1 shows an exploded elevational view of the bushing plate cutter of the present invention.

FIG. 1 shows the bushing plate cutter 1 having a plurality of top plates 2 which abut each other. Attached to the top plates 2, preferably by means of welding, are bushings 5 on one side and blocks 6 on the other side. The blocks 6 have means for mounting drill bits 7 therein.

The bushing plate cutter 1 also comprises a chain 4 and a plurality of sets of side plates 3, with each set of side plates 3 comprising two parallel side plates oriented perpendicularly and abutting the top plates 2 and connected to each other through the chain element 4 and the bushings 5 by means of opposed bolts 8 and nut 9.

Figure 2:
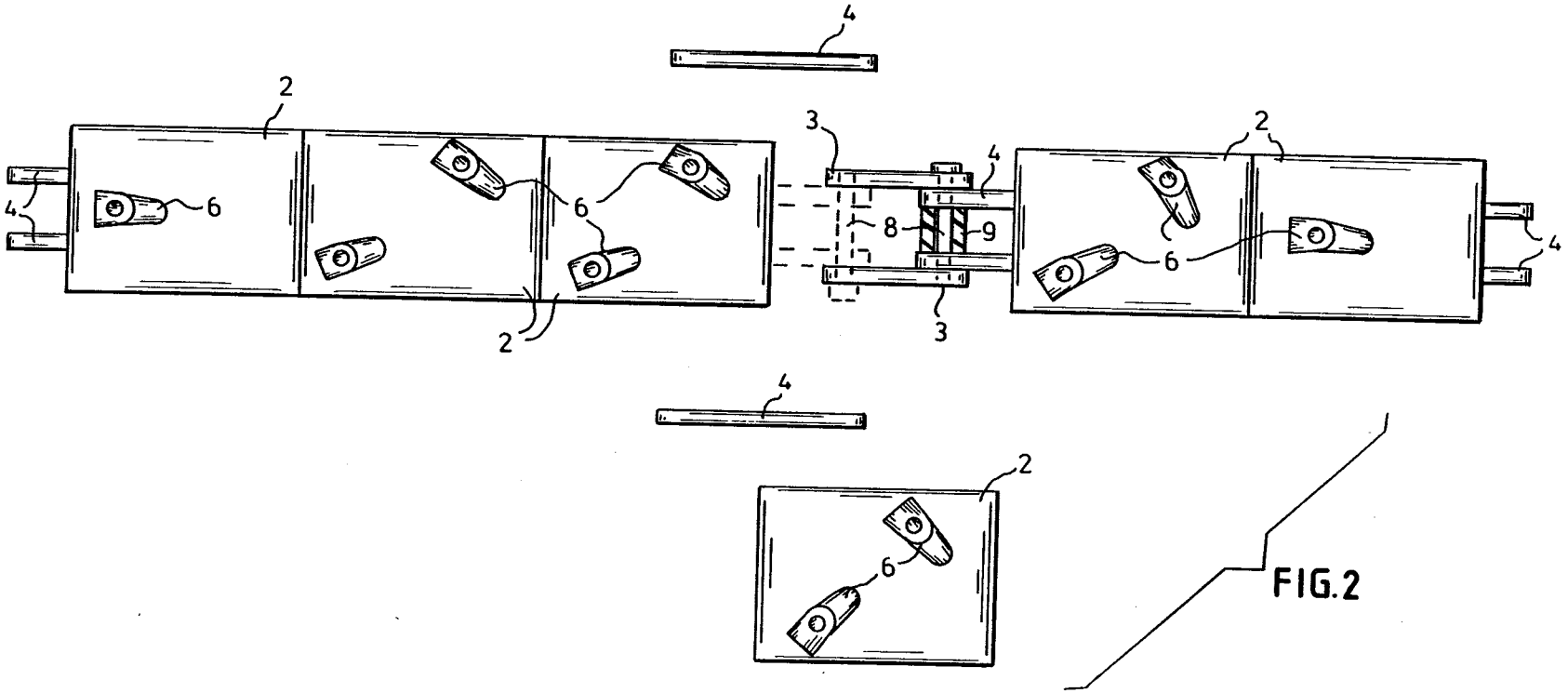
FIG. 2 shows an exploded top view of the bushing plate cutter of the present invention.

FIG. 2 shows the top view of the bushing plate cutter of FIG. 1 with one of the top plates 2 removed. The reference numbers shown therein correspond to the numbers given to the elements of FIG. 1.

Figure 3:
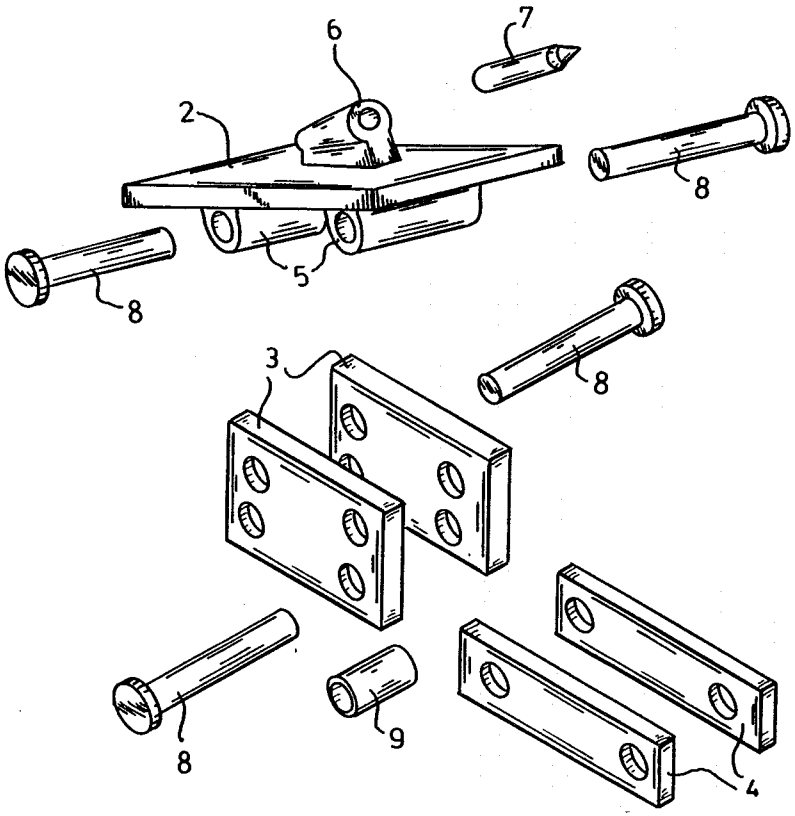
FIG. 3 shows an exploded view of some of the components of the present invention.

FIG. 3 shows various components of the bushing plate cutter of the present invention in detail. The reference numbers shown therein correspond to the numbers given to the elements of FIGS. 1 and 2.

FIG. 4 shows a perspective view of a trenching apparatus having the bushing plate cutter 1 of the present invention mounted thereon. The reference numbers shown for the bushing plate cutter correspond to those of the previous Figures. An important advantage of the present invention is illustrated in FIG. 4 in that, as shown therein, the abutting top plates result in a configuration closely resembling a wheel which makes for a smoother running cutter than the prior art cutters which had nonadjacent top plates in that the present cutter mimics the action of a chain saw.

Another important innovation of the present invention which can be seen in FIG. 4 is that there is a uniform distance between cutting bits. This arrangement results in the cutter being resistant to backlash and/or back buckling. It also prevents cocking of the top plate element.

FIG. 5 shows a partial perspective view of the trenching apparatus shown in FIG. 4. The reference numbers shown in the Figure correspond to those for the equivalent elements shown in the previous Figures.

An important innovation of the present invention over the prior art is that the side plates are welded to the top plate and bolted together through the bushings and chain rather than being bolted to the top plate. This arrangement has proven to be important in maintaining the structural integrity of the cutter. Also, the opposing orientation of the bolts through the side plates results in an improved tightening of their connection and thus also improves the structural integrity of the cutter.

While there has been described and illustrated herein a specific embodiment of the invention, it will be obvious that various changes, modifications, and additions can be made herein without departing from the field of the invention which is limited only by the scope of the appended claims.

What is claimed is:

1. A bushing plate cutter for excavating trenches in various surfaces such as asphalt, concrete, rocky or icy ground comprising:

a plurality of top plates abutting each other;

a plurality of bushings each welded to one side of one of said top plates;

a plurality of blocks each welded to a side of said top plates opposite to that to which said bushings are welded; said blocks having holes therein for mounting cutting bits;

a plurality of said cutting bits;

a chain comprising a plurality of link elements having holes therein;

a plurality of sets of side plates, each set comprising two substantially parallel side plates substantially perpendicular to and abutting said top plates; and a plurality of bolts which connect the plates of each set of side plates together through said bushing and said chain element holes.

2. The bushing plate cutter of claim 1 wherein said blocks are welded to said top plates such that there is a substantially uniform distance between adjacent cutting bits.

3. The bushing plate cutter of claim 1 wherein each pair ot said bolts connecting one of said sets of parallel side plates together has the bolts oriented in opposite direction.

* * * * *